US005393454A

United States Patent [19]

Mondin et al.

[11] Patent Number: 5,393,454

[45] Date of Patent: Feb. 28, 1995

[54] THICKENED COMPOSITION CONTAINING POLYMERIC THICKENER AND ALIPHATIC HYDROCARBON

[75] Inventors: Myriam Mondin, Seraing S/M; Guy Broze, Grace-Hollogne, both of Belgium

[73] Assignee: Colgate Palmolive Co., Piscataway, N.J.

[21] Appl. No.: 190,934

[22] Filed: Feb. 3, 1994

[51] Int. Cl.[6] ..... C11D 3/37; C11D 3/18; C11D 1/72

[52] U.S. Cl. ..... 252/174.23; 252/174.22; 252/162; 252/142; 252/DIG. 2; 252/173; 252/DIG. 14

[58] Field of Search ..... 252/89.1, 173, 174.18, 252/174.23, DIG. 2, DIG. 15, 142, 174.22, 162, DIG. 14

[56] References Cited

U.S. PATENT DOCUMENTS

| | | | |
|---|---|---|---|
| 4,919,839 | 4/1990 | Durbut et al. | 252/153 |
| 5,039,441 | 8/1991 | Thomas et al. | 252/142 |
| 5,169,553 | 12/1992 | Durbut et al. | 252/99 |

*Primary Examiner*—Christine Skane
*Assistant Examiner*—Lorna M. Douyon
*Attorney, Agent, or Firm*—Richard E. Nanfeldt; Robert C. Sullivan; Murray Grill

[57] ABSTRACT

A thickened composition having a complex viscosity at 1.58 Hz of about 0.1 to about 200 Pascal seconds, a G' value of about 0.1 to about 1500 dynes/sq cm over a strain range of 1 to 5% and a G" value of about 0.1 to about 1000 dynes/sq cm over a strain range of 1 to 5% which comprises approximately by weight 2 to 25 wt % of a nonionic surfactant having an HLB of about 0.1 to about 8.0; 0.1 to 10.0 wt % of a polymeric thickener; 2 to 30 wt % of an aliphatic hydrocarbon having about 6 to about 22 carbon atoms; and the balance being water.

7 Claims, No Drawings

THICKENED COMPOSITION CONTAINING POLYMERIC THICKENER AND ALIPHATIC HYDROCARBON

This invention relates to a thickened surfactant containing composition and the processes for the manufacture and use thereof. More particularly, it relates to a thickened stable surfactant containing composition in concentrated form which is effective to clean soils from substrates such as bathroom fixtures and walls. The thickened compositions more readily clings to a vertical surface and has less tendency to sag or run down the vertical surface than which are microemulsions described in U.S. Pat. Nos. 5,076,954, 4,919,839, 5,075,026 and 5,082,584. The instant described thickened compositions comprise a synthetic organic nonionic detergent, a water insoluble organic compound, water and an associative polymeric thickener which causes a lipophilic lipophilic interaction between the nonionic surfactant and the associative thickener. When the pH of the composition is on the acid side, preferably in the range of 1 to 5, the invented compositions could be useful for removing lime scale and soap scum from hard substrates.

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319, and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositings of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130, but these normally include higher percentages of synthetic organic detergent, which increased detergent content may be objectionable due to excessive foaming during use that can result from its presence.

Microemulsions have been disclosed in various patents and patent applications for liquid detergent compositions which may be useful as hard surface cleaners or all-purpose cleaners, and such compositions have sometimes included detergent, solvent, water and a co-surfactant. Among such disclosures are European Patent Specifications Nos. 0137615, 0137616 and 0160762, and U.S. Pat. No. 4,561,991, all of which describe employing at least 5% by weight of the solvent in the compositions. The use of magnesium salts to improve grease removing in microemulsion liquid detergent compositions is mentioned in British Patent Specification No. 2144763. Other patents on liquid detergent cleaning compositions in microemulsion form are U.S. Pat. Nos. 3,723,330, 4,472,291 and 4,540,448. Additional formulas of liquid detergent compositions in emulsion form which include hydrocarbons, such as terpenes, are disclosed in British Patent Specifications Nos. 1603047 and 2033421, European Patent Specification No. 0080749, and U.S. Pat. Nos. 4,017,409, 4,414,128 and 4,540,505. However, the presence of builder salts in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious subject matter disclosed and claimed herein. In accordance with the present invention a stable thickened surfactant containing composition comprises a nonionic synthetic organic detergent, an associative polymer thickener, a water insoluble aliphatic hydrocarbon and water, thereby producing a stable thickened composition which is stable at room temperatures. The compositions are especially effective for cleaning soils from substrates. When the compositions are acidic, they could also useful to remove lime scale and soap scum from hard surfaces such as bathroom fixtures, floors and walls.

SUMMARY OF THE INVENTION

The present invention provides a stable thickened surfactant containing composition which is suitable for cleaning vertical hard surfaces such as plastic, vitreous and metal surfaces.

In one aspect of the invention a stable thickened composition which is especially effective in the removal of soil from hard surfaces comprises approximately on a weight basis: 2 to 25% of a nonionic synthetic organic detergent, 2 to 30% of a substantially water insoluble aliphatic hydrocarbon having about 6 to about 22 carbon atoms, about 0.1 to about 10.0 wt % of an associative polymer wherein the associative polymer thickener forms connecting lipophilic-lipophilic bridges between the nonionic synthetic organic detergent and the associative thickener polymer and the balance being water, said proportions being based upon the total weight of the composition.

Preferred concentrations of the mentioned components of the thickened composition comprises approximately by weight 2 to 15% of nonionic synthetic organic detergent, 2 to 20% of aliphatic hydrocarbon, 0.1 to 5.0% of associative polymeric thickener, and the balance being water. The cleaning composition comprises the described components with minor proportions of compatible adjuvants being permissible. Among the desirable adjuvants that may be present in the thickened compositions are divalent or polyvalent metal salts, as sources of magnesium and aluminum, which improve cleaning performances of the dilute compositions, and higher fatty acids and/or higher fatty acid soaps which act as foam suppressants.

DETAILED DESCRIPTION OF THE INVENTION

The present invention relates to a thickened surfactant containing compositions which approximately by weight comprises:

(a) 2 to 25 percent of a nonionic surfactant;

(b) 0.1 to 10.0 percent of an associative thickener polymer;

(c) 2 to 30 percent of an aliphatic hydrocarbon; and (d) the balance being water The aliphatic hydrocarbons used in the instant thickened composition can be straight chained or branched chained hydrocarbons having about 6 to about 22 carbon atoms, more preferably about 8 to about 18 carbon atoms and most preferably about 9 to about 14 carbon atoms, wherein the most preferred aliphatic hydrocarbon is decane.

The concentration of the aliphatic hydrocarbon in the thickened composition is about 2 to about 30 wt %, more preferably about 2.0 to about 6.0 wt %.

The water soluble or water dispersible nonionic synthetic organic detergents that are employed in the invented cleaning compositions are usually condensation products of an organic aliphatic or alkylaromatic hydrophobic compound and ethylene oxide, which is hydrophilic. Almost any hydrophobic compound having a carboxy, hydroxy, amido or amino group with a free hydrogen present can be condensed with ethylene oxide or with polyethylene glycol to form a nonionic detergent. The length of the polyethenoxy chain of the condensation product can be adjusted to achieve the desired balance between the hydrophobic and hydrophilic elements (HLB) and such balances may be measured by HLB numbers.

Particularly suitable nonionic detergents are the condensation products of a higher aliphatic alcohol, containing about 8 to 18 carbon atoms in a straight or branched chain configuration, condensed with about 2 to 30, preferably 5 to 9 moles of ethylene oxide. A particularly preferred compound is $C_{10-14}$ alkanol ethoxylate of five ethylene oxides per mole (6.5 EtO), which also may be designated as $C_{10-14}$ alcohol EO 5:1, $C_{12-15}$ alkanol ethoxylate (6.5 EO) or $C_{12-15}$ alcohol EO 6.5:1 is also preferred. Such nonionic detergents are commercially available from Shell Chemical Co. under the trade names Dobanol 23-65, Dobanol 91-5 and Neodol 25-7.

Other suitable nonionic detergents are the polyethylene oxide condensates of one mole of alkyl phenol containing from about 6 to 12 carbon atoms in a straight or branched chain configuration, with about 2 to 30, preferably 2 to 15 moles of ethylene oxide, such as nonyl phenol condensed with 9 moles of ethylene oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

Another well-known group of usable nonionic detergents is marketed under the trade name "Pluronics." These compounds are block copolymers formed by condensing ethylene oxide with a hydrophobic base formed by the condensation of propylene oxide with propylene glycol. The molecular weight of the hydrophobic portion of the molecule is of the order of 950 to 4000, preferably 1200 to 2500. The condensation of ethylene oxide with the hydrophobic moiety increases the water solubility of the molecule. The molecular weight of these polymers is in the range of 1000 to 15,000 and the polyethylene oxide content may comprise 20 to 80% thereof.

Still other satisfactory nonionic detergents are a condensation product of a $C_{10-16}$ alkanol with a heteric mixture of ethylene oxide and propylene oxide. The mole ratio of ethylene oxide to propylene oxide is from 1:1 to 4:1, preferably from 1.5:1 to 3.0:1, with the total weight of the ethylene oxide and propylene oxide contents (including the terminal ethanol group or propanol group) being from 60 to 85%, preferably 70 to 80%, of the molecular weight of the nonionic detergent. Preferably, the higher alkanol contains 12 to 15 carbon atoms and a preferred compound is the condensation product of $C_{13-15}$ alkanol with 4 moles of propylene oxide and 7 moles of ethylene oxide. Such preferred compounds are commercially available from BASF Company under the trade name Lutensol LF.

Also suitable for incorporation in the invented cleaning compositions are the nonionic detergents that are derived from the condensation of ethylene oxide with the product resulting from the reaction of propylene oxide and ethylene diamine. For example, satisfactory such compounds contain from about 40 to 80% of polyoxyethylene by weight, have a molecular weight of from about 5000 to 11,000 and result from the reaction of ethylene oxide with a hydrophobic base which is a reaction product of ethylene diamine and excess propylene oxide, and which is of a molecular weight in the range of 2500 to 3000.

Additionally, polar nonionic detergents may be substituted for the generally nonpolar nonionic detergents described above. Among such polar detergents are those in which a hydrophilic group contains a semipolar bond directly between two atoms, for example, N—O and P—O. There is charge separation between such directly bonded atoms but the detergent molecule bears no net charge and does not dissociate into ions. Suitable such polar nonionic detergents include open chain aliphatic amine oxides of the general formula $R^7—R^8—R^9N—O$ wherein $R^7$ is an alkyl, alkenyl or monohydroxyalkyl radical having about 10 to 16 carbon atoms and $R^8$ and $R^9$ are each selected from the group consisting of methyl, ethyl, propyl, ethanol, and propanol radicals. Preferred amine oxides are the $C_{10-16}$ alkyl dimethyl and dihydroxyethyl amine oxides, e.g., lauryl dimethyl amine oxide and lauryl myristyl dihydroxyethyl amine oxide. Other operable polar nonionic detergents are the related open chain aliphatic phosphine oxides having the general formula $R^{10}R^{11}R^{12}P—O$ wherein $R^{10}$ is an alkyl, alkenyl or monohydroxyalkyl radical of a chain length in the range of 10 to 18 carbon atoms, and $R^{11}$ and $R^{12}$ are each alkyl or monohydroxyalkyl radicals containing from 1 to 3 carbon atoms. As with the amine oxides, the preferred phosphine oxides are the $C_{10-16}$ alkyl dimethyl and dihydroxyethyl phosphine oxides.

The concentration of the nonionic surfactant in the thickened composition is about 2 to about 25 wt %, preferably about 2 to about 8 wt %.

Many other suitable nonionic detergents that may be derisive components of the present compositions are described in texts denoted to detergency, detergent compositions and components, including Surface Active Agents (Their Chemistry and Technology) by Schwartz and Perry, and the various annual editions of John W. McCutcheon's Detergents and Emulsifiers.

The polymeric associative thickeners are manufactured and sold by BASF Company under the name Pluracol TH922 and Pluracol TH916. These polymeric associative thickeners are nonionic polymers obtained by the reaction of an alkylene oxide copolymer having a molar mass of about 5000 to 50,000 and having an OH functionality at each end of the polymeric chain with two long alkyl chain epoxides each of which has about 12 to about 24 carbon atoms. The associative polymeric thickener can be characterized by the formula:

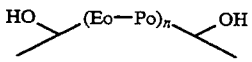

wherein n is about 20 to about 500, and the ratio of Eo to Po is 3:1

The concentration of the associative polymeric thickener in the thickened composition is about 0.1 to about 10.0 wt %, more preferably about 0.1 to about 4 wt % and most preferably about 0.1 to about 2.5 wt %.

The final essential component of the invented thickened composition is water. Such water may be tap water, usually of less that 150 ppm hardness, as $CaCO_3$, but preferably will be deionized water or water of hardness less than 50 ppm, as $CaCO_3$. The proportion of water in the thickened composition is from about 45 to about 95 wt % and more preferably about 60 to about 90 wt %.

The thickened compositions of the instant invention may also optionally contain about 0.1 to about 10.0 wt. percent of an acidic component.

The active acidic component of the thickened composition can optionally be a carboxylic acid which is strong enough to lower the pH of the thickened composition to one in the range of one to four. Various such carboxylic acids can perform this function but those which have been found effectively to remove soap scum and lime scale from the bathroom surfaces best, while still not destabilzing the emulsion, are polycarboxylic acids, and of these the dicarboxylic acids are preferred. Of the dicarboxylic acids group, which includes those of 2 to 10 carbon atoms, from oxalic acid through sebacic acid, suberic, azelaic and sebacic acids are of lower solubilities and therefore are not as useful in the present thickened composition as the other dibasic aliphatic fatty acids, all of which are preferably saturated and straight chained. Oxalic and malonic acids, although useful as reducing agents too, may be too strong for delicate hard surface cleanings. Preferred such dibasic acids are those of the middle portion of the 2 to 10 carbon atom acid range, succinic glutaric, adipic and pimelic acids, especially the first three thereof, which fortunately are available commercially as a mixture. The diacids, after being incorporated in the invented thickened composition may be partially neutralized to produce the desired pH in the thickened composition, for greatest functional effectiveness, with safety.

Phosphoric acid is one of the additional acids that helps to protect acid-sensitive surfaces being cleaned with the present thickened composition. Being a tribasic acid, it too may be partially neutralized to the biphosphate, e.g., $NaH_2PO_4$, or $NH_4H_2PO_4$.

Phosphonic acid, the other of the two additional acids for protecting acid-sensitive surfaces from the dissolving action of the dicarboxylic acids of the present emulsions, apparently exists only theoretically, but its derivatives are stable and are useful in the practice of the present invention. Such are considered to be phosphonic acids, as that term is used in this specification. The phosphonic acids are of the structure.

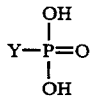

wherein Y is any suitable substituent, but preferably Y is alkylamine or N-substituted alkylamino. For example, a preferred phosphonic acid component of the present emulsions is aminotris-(methylenephosphonic) acid, which is of the formula $N(CH_2PH_2O_3)$. Among other useful phosphonic acids are ethylenediamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 or 4 lower alkylenephosphonic acid groups of 2 to 6 carbon atoms each, which alkylene(s) is/are present and join amino nitrogens when a plurality of such amino nitrogens is present in the aminoalkylenephosphonic acid. It has been found that such aminoalkylenephosphonic acids, which also may be partially neutralized help prevent harmful attacks on European enamel surfaces by the diacid(s) components of the cleaner. Usually the phosphorus acid salts, if present, will be monosalts of each of the phosphoric and/or phosphonic acid groups present.

Of all the organic acids which are of sufficient acidity effectively to attack soap scum and to convert it to a form which is readily removable from hard surfaces, such as ceramic tiles, portland cement and acrylic latex grouts between the tiles, porcelain, porcelain enamel, glass, fiberglass and metal (such as chrome and nickel plated) surfaces, glutaric acid or a partially neutralized salt or ionized form thereof is highly preferred, because it performs effectively and has no significantly detrimental negative properties, but in some instances other acids capable of converting calcium and magnesium higher fatty acid soaps to acidic or partially neutralized form to assist in removing them from hard surfaces which they are staining (in the form of soap scum) may also be employed (when detrimental properties thereof, if any, are tolerable). Such acids will include those which do not form water insoluble calcium salts. For example, acetic acid, succinic acid, propionic acid and citric acid may be utilized in some circumstances. However, citric acid is a sequestering acid and tends to remove calcium from calcium carbonate in the grout employed between adjacent ceramic tiles, which is detrimental to its use. The other mentioned acids are often unsatisfactory because of unacceptable odors and/or because they result in human nasal and/or respiratory irritation. Of course, those acids which are toxic under the circumstance of use will also preferably be avoided. Therefore, glutaric acid is preferably utilized as such soap scum attacking acid. It may be (and usually is) subsequently partially neutralized to the desired pH range during manufacture of the invented cleaner but it is also within the invention to employ salts of such acid and to convert them to the desired pH, wherein it is recognized that the products of both such operations are the same. Therefore, by reference to "partially neutralized glutaric acid" it is meant also to include such products resulting from partially acidifying glutaric acid salts (glutarates) or from directly incorporating the partially neutralized glutarates of desired pH with the other components of the cleaner.

The thickened composition of this invention may, if desired, also contain other components, either to provide additional beneficial effects or to make the product more attractive to the consumer. The following are mentioned by way of examples: colors or dyes in proportions from 0.0 to 0.5%; bactericides from 0.01 to 1%; and preservatives or antioxidizing agents, such as formalin, 5-bromo-5-nitrodioxan-1,3,5-chloro-2-methyl-4-isothaliazolin-3-one, 2,6-di-tert, butyl-p-cresol, in proportions of 0.01 to 2%. Furthermore, if opaque or pearlescent compositions are desired, 0.05 to 4% by weight of opacifier and/or pearlescing agent may be added. The thickened compositions exhibit a complex viscosity at room temperature in the range of 0.1 to 200 Pascal seconds at a frequency of 1.58 Hz, more preferably about 0.1 to about 100 Pascal seconds at a frequency of 1.58 Hz, a G' value of about 0.1 to about 1500 dynes/sq cm over a strain range of 1 to 50% and a G" value of about 0.1 to about 1000 dynes/sq cm over a strain range of 1 to 50%.

The thickened liquid compositions are preferably packaged in containers of synthetic organic polymeric plastic, e.g., PVC, polyethylene or polypropylene and PET.

The process for forming the thickened compositions of the instant invention comprise: forming a solution of the water and nonionic surfactant and heating the formed solution to above 40° C. at which point the associative thickener is slowly added with stirring to the heated solution. Stirring and heating are continued until a homogenous solution has been obtained at which point the aliphatic hydrocarbon is added with stirring. The solution is cooled to room temperature to form the thickened composition.

EXAMPLE 1

The following examples were prepared but the previously described process, wherein the amounts as stated are in weight percent.

| | A | B | C | D | E | F | G | H |
|---|---|---|---|---|---|---|---|---|
| Dobanol 23-6.5 | | | | | | | | |
| Dobanol 91/8 | 4 | | | | | | | |
| Dobanol 25/7 | | 4 | | | | 4 | 4 | 10 |
| Dobanol 45/11 | | | 4 | | | | | |
| Dobanol 25/3 | | | | 10 | | | | |
| Dobanol 25/9 | | | | | 4 | | | |
| Pluracol TH922 | 2.5 | 2 | 2 | 2 | 2 | 2 | 2 | 2 |
| Decane | — | 2 | — | — | — | 1 | — | — |
| NaCl | — | — | — | — | — | — | — | 1 |
| Water | 93.5 | 92 | 94 | 88 | 94 | 93 | 94 | 87 |
| G' dynes/cm | 1.5 | 1000 | 150 | 400 | 115 | 900 | 260 | 60 |
| G" dynes/cm | 13 | 250 | 160 | 20 | 130 | 260 | 330 | 180 |
| Complex viscosity Pascal seconds | 1.3 | 25 | 16 | 2 | 13 | 26 | 33 | 18 |

| | I | J | K | L | M | N | O |
|---|---|---|---|---|---|---|---|
| Dobanol 23-6.5 | | | | | | | |
| Dobanol 91/8 | | | | | | | |
| Dobanol 25/7 | 4 | 25 | 10 | 10 | 10 | 8 | 10 |
| Dobanol 45/11 | | | | | | | |
| Dobanol 25/3 | | | | | | | |
| Dobanol 25/9 | | | | | | | |
| Pluracol TH922 | 2 | 2 | 2 | 1.5 | 2 | 2 | 2.5 |
| Decane | — | 2 | 2 | — | — | — | — |
| | 1.5 | — | — | — | — | — | — |
| Water | 93.5 | 71 | 86 | 88.5 | 88 | 90 | 87.5 |
| G' dynes/cm | 175 | 180 | 350 | 15 | 50 | 2 | 5 |
| G" dynes/cm | 180 | 290 | 170 | 67 | 190 | 7 | 4 |
| Complex viscosity Pascal seconds | 18 | 29 | 17 | 6.7 | 19 | 0.7 | 0.4 |

The rheological measurements were done at a 1.58 Hz frequency at 25° C.

The invented subject matter has been described with respect to various embodiments and working examples but it is not to be construed as limited to these because it is evident that one of skill in the art, with the present specification before him, will be able to utilize substitutes and equivalents without departing from the scope of the invention herein described.

What is claimed is:

1. A thickened composition having a complex viscosity at 25 C. at 1.58 Hz of about 0.1 to about 200 Pascal seconds, an elastic modulus G' value of about 0.1 to about 1500 dynes/sq cm over a strain range of 1 to 5% and a viscous modulus G" value of about 0.1 to about 1000 dynes/sq cm over a strain range of 1 to 5% which comprises approximately by weight:

(a) 2 to 25% of a nonionic surfactant having an HLB of about 0.1 to about 8.0;

(b) 0.1 to 10.0% of an associative polymeric thickener which is a polymer which is the reaction product of an alkylene oxide copolymer having a molar mass of about 5000 to 50,000 and having an OH functionality at each end of the polymer chain and two alkyl chain epoxides, each of which has about 12 to about 24 carbon atoms;

(c) 2 to 30% of an aliphatic hydrocarbon having about 6 to about 22 carbon atoms; and (d) the balance being water.

2. A composition according to claim 1, wherein said aliphatic hydrocarbon has about 9 to 14 carbon atoms.

3. A composition according to claim 1, wherein said nonionic surfactant is a condensation product of one mole of an aliphatic alcohol having about 8 to 18 carbon atoms with about 5 to about 7 moles of ethylene oxide.

4. A composition according to claim 1, wherein said nonionic surfactant is a condensation product of one mole of an aliphatic alcohol having about 10 to about 14 carbon atoms with about 6 to about 7 moles of ethylene oxide.

5. A composition according to claim 4, wherein said aliphatic hydrocarbon has about 10 to about 14 carbon atoms.

6. A composition according to claim 4, wherein said aliphatic hydrocarbon is decane.

7. The composition of claim 1 further including about 0.1 to about 10.0 wt. percent of an acidic component.

* * * * *